US006733058B1

(12) United States Patent
Nakajima

(10) Patent No.: US 6,733,058 B1
(45) Date of Patent: May 11, 2004

(54) WINDING ROLL LIFTING DEVICE WITH ADJUSTABLE SUPPORTING ARM AND CHUCK MEMBER

(75) Inventor: Kiyoji Nakajima, Tokyo (JP)

(73) Assignee: Himecs Corp., Tokyo (JP)

( * ) Notice: Subject to any disclaimer, the term of this patent is extended or adjusted under 35 U.S.C. 154(b) by 4 days.

(21) Appl. No.: 10/088,537

(22) PCT Filed: Sep. 20, 2000

(86) PCT No.: PCT/JP00/06417

§ 371 (c)(1),
(2), (4) Date: Mar. 20, 2002

(87) PCT Pub. No.: WO01/21515

PCT Pub. Date: Mar. 29, 2001

(30) Foreign Application Priority Data

Sep. 20, 1999 (JP) ..... 11/265165

(51) Int. Cl.[7] ..... B66C 1/54; B65H 19/12

(52) U.S. Cl. ..... 294/86.41; 294/67.21; 294/67.22; 294/67.5; 242/559.1; 414/911

(58) Field of Search ..... 294/67.2, 67.21, 294/67.22, 67.5, 81.3, 81.4, 86.24, 86.25, 86.31, 86.41, 93–97; 414/626, 910, 911; 242/533.2, 559.1

(56) References Cited

U.S. PATENT DOCUMENTS

| | | | | | |
|---|---|---|---|---|---|
| 967,566 | A | * | 8/1910 | Russell | 294/86.14 |
| 1,867,289 | A | * | 7/1932 | Ventresca | 294/96 |
| 1,879,683 | A | * | 9/1932 | Henderson et al. | 294/97 |
| 2,974,995 | A | * | 3/1961 | Calhoun, Jr. | 294/103.2 |
| 3,738,693 | A | * | 6/1973 | Loustalet | 294/97 |
| 4,154,470 | A | * | 5/1979 | Dalglish | 294/93 |
| 4,358,143 | A | * | 11/1982 | Cullen | 294/64.1 |
| 4,557,029 | A | | 12/1985 | Stewart | 29/253 |
| 4,557,515 | A | * | 12/1985 | Read | 294/67.22 |
| 4,685,711 | A | * | 8/1987 | Zuber | 294/86.41 |
| 4,687,244 | A | * | 8/1987 | Cullen et al. | 294/86.41 |
| 4,708,574 | A | * | 11/1987 | Conboy et al. | 414/626 |
| 4,840,323 | A | * | 6/1989 | Nakajima | 242/571.2 |
| 5,642,979 | A | * | 7/1997 | Cullen et al. | 414/911 |
| 5,743,703 | A | | 4/1998 | Nakajima | 414/911 |
| 6,116,669 | A | * | 9/2000 | Scaglia | 294/67.22 |
| 6,354,644 | B1 | * | 3/2002 | Zaguroli et al. | 294/67.22 |
| 6,402,213 | B1 | * | 6/2002 | Scaglia | 294/67.22 |

FOREIGN PATENT DOCUMENTS

| | | | | |
|---|---|---|---|---|
| DE | 3420860 | * | 12/1985 | |
| EP | 863098 | | 9/1991 | |
| EP | 0567917 | * | 11/1993 | |
| EP | 749925 | | 6/1995 | |
| FR | 1512350 | * | 9/1968 | 294/86.24 |
| JP | 4-94940 | | 3/1992 | |
| JP | 4-133945 | | 5/1992 | |
| JP | 6-345295 | | 12/1994 | |
| JP | 11-49410 | | 3/1998 | |
| SU | 0688410 | * | 10/1979 | |

* cited by examiner

*Primary Examiner*—Paul T. Chin
(74) *Attorney, Agent, or Firm*—Wenderoth, Lind & Ponack L.L.P.

(57) ABSTRACT

A winding roll lifting device is provided in which the base end side of a supporting arm (5), having a tip side installed rotatably on a hook part (34) of the lifting device (1), is installed on the upper side of a main body (2), and a base end (8*b*) of a chuck part (8*a*) to be inserted into a winding roll (30) is installed rotatably on the lower side of the main body (2). The supporting arm (5) is rotated about the upper side of the main body (2) in the direction approaching the chuck part (8*a*) in synchronization with the rotation of the chuck part (8*a*) about the lower side of the main body (2) by a drive mechanism of the main body (2) from vertical to horizontal state so as to raise the winding roll (30) from the vertical to horizontal state.

6 Claims, 4 Drawing Sheets

WINDING ROLL LIFTING DEVICE WITH ADJUSTABLE SUPPORTING ARM AND CHUCK MEMBER

BACKGROUND OF THE INVENTION

1. Field of the Invention

The present invention relates to a winding roll lifting device, or simply a lifting device. The winding roll carries sheet materials, such as synthetic resin film, paper, film laminate paper and the like, that are wound around its winding shaft, and the lifting device may be operated so that it can move the winding roll that is initially placed in its vertical or horizontal position toward its horizontal position or vertical position. The present invention also relates to a winding roll holding device, or simply a holding device, that may be used in conjunction with the lifting device, wherein in a situation in which the winding roll being lifted by the lifting device, with its chuck member being inserted into a central recess provided on the winding roll, is slipping out of the lifting device, the holding device may be operated automatically so that it can engage the inner wall of the central recess on the winding roll more firmly.

2. Prior Art

Conventionally, a plurality of parallel winding rolls (e.g. four to five winding rolls), each of which carries sheet materials, such as synthetic resin film, paper, film laminate paper and the like, that are wound around its winding shaft, are placed in their vertical positions onto a transport pallet. Those winding rolls may be traveling on the transport pallet toward the workstation, where the winding rolls are repositioned from the vertical state to the horizontal state, and are then mounted on a machine. In this prior art, the primary considerations are to assure the quality of the sheet materials carried by the winding rolls and to utilize the available space effectively.

Generally, the winding roll lifting device that is used in moving the winding roll from its vertical position into its horizontal position has a chuck member that may engage a central recess provided on the winding roll by being inserted into the central recess, when it is initially placed in its vertical position. Actually, when the winding roll is to be moved from its vertical position to its horizontal position, the chuck member may be inserted into or engage the central recess from the top, and may then be turned pivotally into its horizontal position, causing the winding roll to be raised into its horizontal position.

In the conventional winding roll lifting device described above, the part of the lifting device that dynamically acts as a point of force (which usually corresponds to the hook member in the lifting device) is initially located just above the center of gravity of the winding roll, and is aligned with the center of gravity along the vertical line. As the winding roll is being lifted by the lifting device toward its horizontal position, however, the distance between the position of a vertical line along which the force point is located and the position of a vertical line along which the gravity point of the winding roll is located becomes greater. In general, the location along the vertical line of the hook member of the lifting device acting as the force point is fixed, and the location along the vertical line of the center of gravity of the winding roll may move further away from the location of the force point, as the winding roll is being lifted into its horizontal position. Thus, the prior art lifting device has a problem in that the pivotal movement of the chuck part from its vertical position to its horizontal position cannot occur with stability. The problem that causes the distance between the vertical line position where that part of the lifting device that dynamically acts as the force point (which corresponds to the hook member of the lifting device) is located and the vertical line position where the center of gravity of the winding roll is located to become gradually greater may become more serious when elongated objects, such as winding rolls, that are massive or have a greater width than diameter are being lifted from the vertical position into the horizontal position. This may also cause the instability problem to become worse when such objects are being lifted by the chuck member from the vertical position into the horizontal position.

Because the winding roll that carries sheet materials, such as synthetic resin film, paper, film laminate paper and the like wound around its winding shaft, is massive, the instability problem, coupled with the problem that causes the distance between the vertical line location of the force point (which corresponds to the location of the hook member) and the vertical line location of the center of gravity of the winding roll to become greater, may introduce another problem in that the mounting operation of the winding roll in its horizontal position onto a machine cannot be performed with high safety, and the operation cannot proceed with high speed.

As described, the winding roll may be moved from its vertical position into its horizontal position as it is held by the chuck member. To do this, the chuck member includes an inflatable member around its outer surface into which compressed air may be introduced. After the chuck member is inserted into the central recess of the winding roll, the compressed air may be introduced into the inflatable member, which may enlarge the external diameter of the chuck member so that the chuck member can engage the inner wall of the central recess of the winding roll more firmly.

It should be noted, however, that for the massive winding roll, the frictional force between the chuck member and the inner wall of the central recess may not be able to overcome the weight of the winding roll gradually until the winding roll is finally slipping out of the chuck member, even if a large amount of compressed air is introduced into its inflatable member. This may also cause the instability problem when the winding roll is being lifted.

This instability problem may become more apparent when the winding roll is placed in its vertical position, as the total weight of the winding roll acts in the vertical direction.

In light of the problems associated with the winding roll lifting device of the prior art that occur when the winding roll is lifted from its vertical position into its horizontal position, the present invention proposes to provide a winding roll lifting device, or simply a lifting device, that allows the winding roll in its vertical position to be lifted into its horizontal position with high safety and with high speed. The present invention also proposes to provide a winding roll holding device, or simply a holding device, that prevents the winding roll from slipping out of the chuck member while it is being lifted by the chuck member. This holding device may be used in conjunction with the lifting device of the present invention or the lifting device of the prior art described above.

SUMMARY OF THE INVENTION

The present invention addresses the problems described above, and solves the problems by allowing the vertical line position of that part of the winding roll lifting device that dynamically acts as a point of force (which usually corresponds to the hook member in the lifting device) to move in the same direction as the direction in which the vertical line position where the center of gravity of the winding roll is located is moving, thereby keeping the distance between the vertical line position of the force point and the vertical line position of the center of gravity as small as possible when the winding roll is being lifted by the lifting device from its vertical position into its horizontal position.

The problems may also be solved by providing a winding roll holding device, or simply a holding device, that includes an eccentric cam member. If a situation where the winding roll being lifted by the lifting device with its chuck member being inserted into the central recess on the winding roll is slipping out of the chuck member should occur, the holding device may be operated automatically so that its eccentric cam member may be forced against the inner wall of the central recess, thereby engaging the inner wall of the central recess of winding roll more firmly.

More specifically, those problems are solved by providing a winding roll lifting device, or simply a lifting device, that includes a main body, the main body including a drive mechanism attached thereto that may be activated to move the winding roll from its vertical position into its horizontal position, a supporting arm member having its base end pivotally mounted to the upper end side of the main body and having its forward end pivotally mounted to that part of the lifting device that acts as the point of force (which corresponds to the hook member of the lifting device), and a chuck member having its base end pivotally mounted to the lower end side of the main body. When the chuck member is driven by the drive mechanism attached to the main body so that it may turn pivotally about the lower end side of the main body, moving from the vertical position into the horizontal position, the supporting arm member may be synchronized with the pivotal movement of the chuck member, turning pivotally about the upper end side of the main body in the direction approaching the chuck member, thereby keeping the distance between the vertical line position of the before described force point (that is, the hook member of the lifting device) and the vertical line position of the center of gravity of the winding roll is maintained as small as possible.

Similarly, the problems are solved by providing a winding roll holding device, or simply a holding device, that may be used in conjunction with the winding roll lifting device of the present invention or the winding lifting device of the prior art. The holding device includes a shaft that is mounted to the forward end of the chuck member of the winding lifting device so that it can advance or retract in the axial direction of the chuck member as it is inserted into the central recess of the winding roll, and an eccentric cam member that is supported on the forward end side of the chuck member and is operatively linked with the advancing or retracting movement of the shaft, so that it can turn pivotally in the axial direction of the chuck member with the advancing or retracting movement of the shaft. Thus, the eccentric cam member may initially be forced against the inner wall of the central recess after the chuck member is inserted into the central recess of the winding roll. If the winding roll should then begin slipping out of the chuck member, the eccentric cam member may be further forced by that slipping action against the inner wall of the central recess, so that the eccentric cam member can engage the inner wall of the central recess on the winding roll more firmly.

More specifically, several aspects of the present invention will be described by referring to the accompanying drawings. In the following description and for the simplicity of the description, the winding roll lifting device may be referred to simply as the lifting device, which should still be understood to mean the winding roll lifting device. In one aspect, the lifting device, which is generally represented by 1, includes a main body 2. The main body 2 includes a drive mechanism (not shown) attached thereto that may be activated to lift a winding roll 30 from its vertical position into its horizontal position. The lifting device also includes a supporting arm member 5 having its base end pivotally mounted to the upper end of the main body 2, a hook member extending from the supporting arm member 5 and pivotally connected to the forward end of the supporting arm member 5, and a chuck member **8*b* having its base end pivotally mounted to the lower end of the main body 2 and which is adapted to be inserted into a central recess of the winding roll 30. The central recess on the winding roll 30 is configured to accept the chuck member 8*a* therein. Thus, when the chuck member 8*a* is driven by the drive mechanism within the main body 2, it can be operated to turn pivotally about the lower end side of the main body 2, moving from its vertical position into its horizontal position. The supporting arm member 5 may then be synchronized with the pivotal movement of the chuck member 8*a*, turning pivotally about the upper end side of the main body 2 in the direction approaching the chuck member 8*a*. In this way, the winding roll 30 may be lifted by the chuck member 8*a* from its vertical position into its horizontal position, with the chuck member 8*a* being inserted into the central recess of the winding roll 30**.

In another aspect, the winding roll lifting device, or simply a lifting device, which is generally represented by 1, includes a main body 2, and the main body 2 includes a drive means 3 attached thereto. The lifting device also includes a supporting arm member 5 having its base end pivotally mounted to the upper end side of the main body 2, a hook member extending from the supporting arm member 5 and pivotally connected to the forward end of the supporting arm member 5, a lifting arm member 7 configured to include the chuck member **8*a* having its base end pivotally mounted to the lower end of the main body 2 and having its forward end adapted to be inserted into a central recess of the winding roll 30, a supporting shaft member 10 which is driven by the drive means 3 and which moves upwardly and downwardly within the main body, and an arm rod member 11 freely fitted to the supporting shaft member 10 at the middle point thereof and having its first end pivotally mounted to the supporting arm member 5 and having its second end pivotally mounted to the lifting arm member 7**.

In still another aspect, the winding roll holding device, or simply a holding device, which is generally represented by 40, may be used in conjunction with the lifting device of the present invention or may be used with the prior art lifting device. The holding device includes a shaft member 38 that may be mounted to the forward end of the chuck member **8*a* so that the shaft member 38 can advance or retract in the axial direction of the chuck member 8*a* as the chuck member 8*a* is inserted into the central recess of the winding roll 30, and includes an eccentric cam member 39 pivotally supported on the forward end of the chuck member 8*a* and operatively linked with the advancing or retracting movement of the shaft member 38 so that the eccentric cam member 39 can turn pivotally in the axial direction of the chuck member 8*a***.

In a further aspect, although this is not shown, a winding roll lifting device may include a winding roll holding device 40, wherein the holding device 40 includes a chuck member

8*a*. The chuck member 8*a* includes a shaft member 38 mounted to the forward end of the chuck member 8*a* so that the shaft member 38 can advance or retract in the axial direction of the chuck member, and an eccentric cam member 39 is pivotally supported on the forward end of the chuck member 8*a* and operatively linked with the advancing or retracting movement of the shaft member 38 so that the eccentric cam member 39 can turn pivotally in the axial direction of the chuck member 8*a*.

According to the aspects of the present invention as described above, the distance between the vertical line position of that part of the lifting device 1 that dynamically acts as the force point (which corresponds to the location of the hook member in the lifting device) and the vertical line position where the center of gravity of the winding roll can be kept as small as possible, when any massive, elongated winding roll is being lifted from its vertical position into its horizontal position. Thus, the movement of such winding roll from the vertical position into horizontal position can occur with high safety and with high speed.

When the holding device 40 is used with the lifting device, it may ensure that the movement of the winding roll being lifted by the chuck member can proceed with safety, without causing the winding roll to slip out of the chuck member.

BRIEF DESCRIPTION OF THE DRAWINGS

FIG. 1(*b*) is a front view illustrating the winding roll lifting device, wherein the winding roll being lifted by the lifting device is being moved into its horizontal position in accordance with one preferred embodiment of the present invention;

DETAILED DESCRIPTION OF THE INVENTION

Several preferred embodiments of the present invention are now described by referring to the accompanying drawings.

First Embodiment

Figure 1:
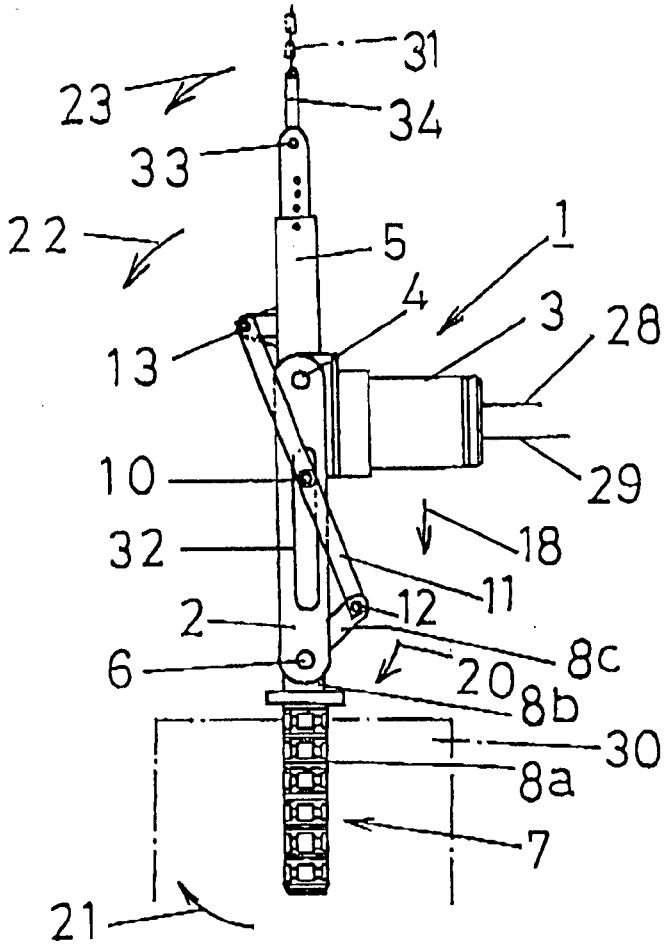
FIG. 1(*a*) is a front view illustrating the winding roll lifting device, wherein the winding roll being lifted by the lifting device is initially placed in its vertical position in accordance with one preferred embodiment of the present invention.
Figure 1:
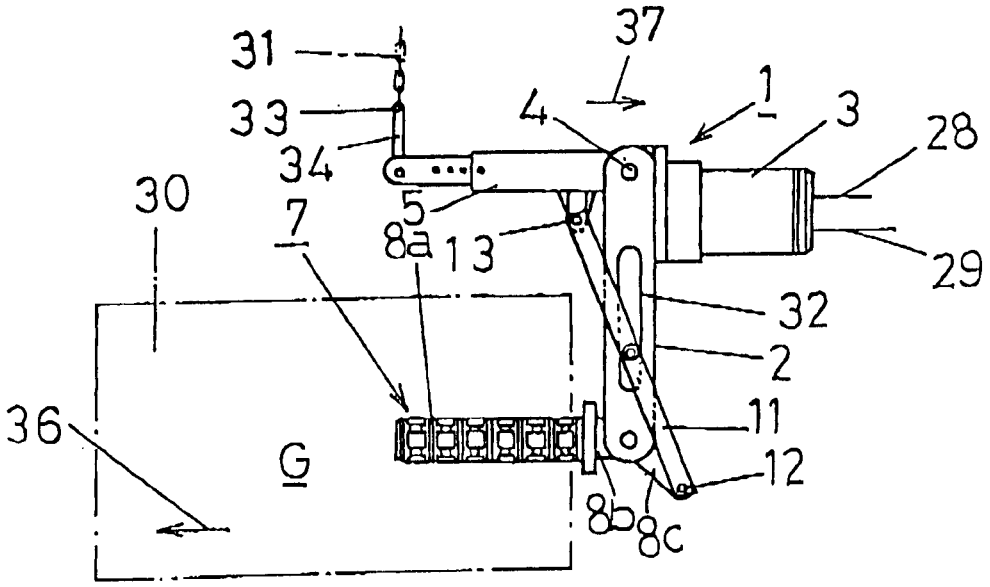
Figure 2:
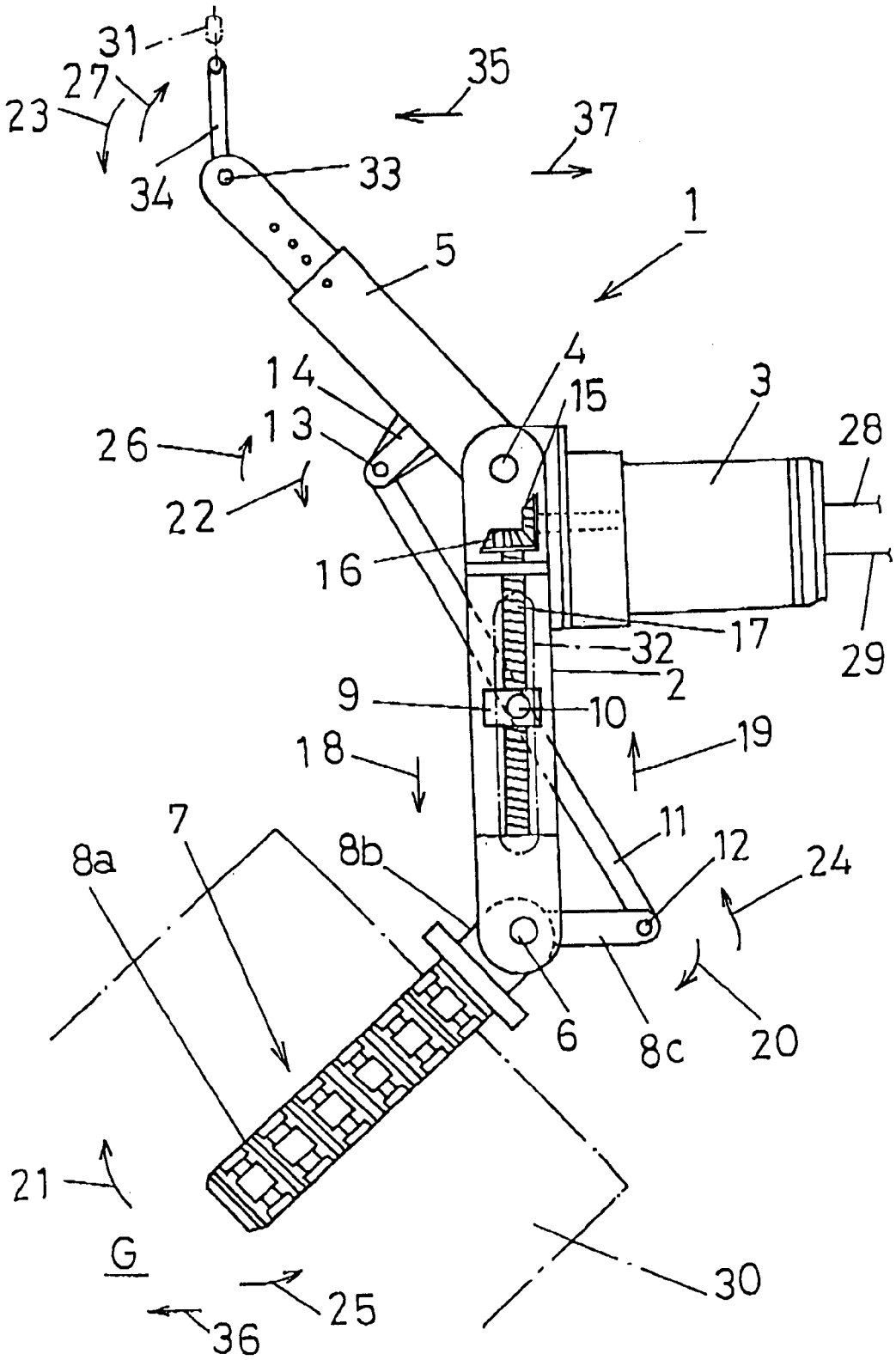
FIG. 2 is a front view illustrating the winding roll lifting device, and serves to explain how the winding roll is being lifted by the lifting device in accordance with one preferred embodiment of the present invention.

Referring first to FIGS. 1(*a*) and (*b*), and FIG. 2, the winding roll lifting device according to a first preferred embodiment of the present invention is described. In the following description, the winding roll lifting device will be referred to simply as the lifting device for the purpose of simplicity, except as otherwise specified.

As shown in FIG. 2, the lifting device, which is generally represented by reference numeral 1, includes a main body 2, the main body 2 including a drive means such as a gear motor 3 attached thereto, a supporting arm member 5 extending from the upper (first) end of the main body 2 and whose base end is mounted to the upper end of the main body 2 by a pivotal shaft or pin 4 so that the supporting arm member 5 can turn pivotally about the pivotal shaft or pin 4, and a lifting arm member 7 extending from the lower (second) end of the main body 2 and whose base end is mounted to the lower end of the main body 2 by a pivotal shaft on pin 6 so that the lifting arm member 7 can turn pivotally about the pivotal shaft or pin 6.

The lifting device 1 further includes a hook member 34 that extends from the second end of the supporting arm member 5 opposite its base end and whose base end is mounted to the second end of the supporting arm member 5 by a pivotal shaft or pin 33 so that the hook member 34 can turn pivotally about its pivotal shaft or pin 33.

The lifting arm member 7 is configured to include a base end 8*b* pivotally mounted to the pivotal shaft 6, a link member 8*c* extending from the part of base end 8*b* pivotally mounted to the pivotal shaft 6 in the direction opposite the lifting arm member 7, and a chuck member 8*a* connected to the base end 8*b* and which may be operated to hold a winding roll 30 by inserting and engaging a central recess provided on the winding roll 30.

As shown in FIG. 2, there is a screw rod member 17 that is rotatably mounted within the main body 2, and has a spiral thread extending along the length of the screw rod member 17. A bearing 9 is provided for engaging the screw rod 17, and is secured to a support shaft member 10 that extends through a longitudinal slit 32 provided on the lateral wall of the main body 2.

An arm rod member 11 is freely mounted to the support shaft member 10 so that it can be supported swingably by the support shaft member 10 at the middle point of the arm rod member 11. The arm rod member 11 has its upper (first) end mounted to a link member 14 by a pivotal shaft or pin 13 so that it can turn pivotally about the pivotal shaft or pin 13. The link member 14 is secured to the supporting arm member 5. The arm rod member 11 also has its lower (second) end mounted to the link member 8*c* on the lifting arm member 7 by a pivotal shaft or pin 12 so that it can turn pivotally about the pivotal shaft or pin 12.

The operation of the winding roll lifting device 1 that has been described above will now be described. In the following description, it is assumed that the winding roll 30 is initially placed in its vertical position as shown in FIG. 1(*a*), and is then lifted into its horizontal position as shown in FIG. 1(*b*).

The lifting device 1, which is now suspended by means of a chain 31, is then moved toward the top of the winding roll 30 that is placed in its vertical position as shown in FIG. 1(*a*). Then, the lifting device 1 is further moved so that the chuck member 8*a* of the lifting arm member 7 can be inserted into the central recess of the winding roll 30. Then, the winding roll 30 is held by the chuck member 8*a*.

The gear motor 3 is connected to the external power supply (not shown) via a power supply cord 28, and is controlled by a controller (not shown) that is connected to the gear motor 3 via a control signal cord 29. The gear motor 3 may then be started up.

The gear motor 3 has a rotary shaft having a bevel gear 15 at the forward end thereof. A bevel gear 16 that engages the bevel gear 15 is provided on the upper side end of the screw rod member 17. As the gear motor 3 is rotated, its rotation may be transmitted through the rotary shaft and its bevel gear 15 to the bevel gear 16. This causes the screw rod member 17 to rotate about its axis. Then, the bearing 9 that engages the screw rod member 17 may be moved downwardly, that is, in the direction of an arrow 18. The support shaft member 10 that is secured to the bearing 9 may also be moved in the direction of the arrow 18.

As described, the arm rod member 11 is supported freely by the support shaft member 10 at its middle point, and has its (first) end pivotally connected to the link member 14 by the pivotal shaft or pin 13, and the second end pivotally connected to the link member 8*c* of the lifting arm member 7 by the pivotal shaft or pin 12. As also described, the supporting arm member 5 has its forward (second) end pivotally connected to the hook member 34 of the lifting device 1 by the pivotal shaft or pin 33, with the base (first) end being pivotally connected to the upper (first) end of the main body 2 by the pivotal shaft or pin 4. Furthermore, the lifting arm member 7 is pivotally connected to the lower (second) end of the main body 2 by the pivotal shaft or pin 6. As the support shaft member 10 moves in the direction of the arrow 18 as shown in FIG. 2, the link member 14 may be moved in the direction of arrow 22, and the link member 8*c* may be turned in the direction of an arrow 20. As those link members 14 and 8*c* are moving, the chuck member 8*a* may be turned about pin 6 in the direction of arrow 21, and the supporting arm member 5 may be turned about pin 4 in the direction of arrow 23. Those turnings of the members are accomplished synchronously. More specifically, as the chuck member 8*a* is driven by the drive mechanism attached with the main body 2 so that it can be turned pivotally about the (second) end of the main body 2, moving from the vertical position into the horizontal position, the supporting arm member 5, whose pivotal movement is synchronized with that of the chuck member 8*a*, can also turn pivotally about the (first) end of the main body 2, in the direction approaching the chuck member 8*a*. Then, the winding roll 30, with its central recess being engaged by the chuck member 8*a*, may be lifted from its vertical position into its horizontal position.

As the chuck member 8*a* is turned in the direction of the arrow 21 (FIG. 2) until it finally reaches its horizontal position as shown in FIG. 1(*b*), the center of gravity G of the winding roll 30 may be moved in the direction of arrow 36 (FIG. 2).

In the winding roll lifting device 1 according to the present invention, as the center of gravity G of the winding roll 30 is moved, the vertical line position of the part of lifting device 1 at which it dynamically acts as the point of force (which, in this embodiment, corresponds to the location of the hook member 34, more specifically, to the location of the pivotal shaft pin 33 to which the hook member 34 is pivotally mounted on the second end of the supporting arm member 5) may be synchronized with the movement of the center of gravity G of the winding roll 30 as shown by the arrow 36, moving in the same direction as that indicated by the arrow 36, that is, in the direction of arrow 35 (FIG. 2).

It may be appreciated that as the center of gravity G of the winding roll 30 and that part of the lifting device 1 that dynamically acts as the force point are synchronized, they can be moving in the same direction. Thus, the distance between any particular location along the vertical line passing through the center of gravity G and the corresponding location of a point along the vertical line passing through the force point may be kept as small as possible. Accordingly, when each individual winding roll is moved from its vertical position (FIG. 1(*a*)) into its horizontal position (FIG. 1(*b*)), this can occur with stability. This allows the operation to proceed with a higher speed, with increased safety, and with higher efficiency.

It should be noted that the embodiment described above is presented to provide an easy understanding of the present invention. In this embodiment, the vertical line position of that part of the winding roll lifting device 1 that dynamically acts (passes through) as the force point (which corresponds to the location of the pivotal shaft 33 along the vertical line) may be moving the same as the vertical line passing through the center of gravity G and moving in the same direction as the direction 36 in which the gravity point G is moving (i.e. in the direction as indicated by the arrow 35). It should be understood, however, that the present invention is not limited to the above embodiment.

As a variation of the above embodiment, the position where that part of the lifting device 1 that dynamically acts as the force point (which corresponds to the location of the pivotal pin 33 along the vertical line) is located along the vertical line may be fixed. In this variation, as the winding roll 30 is moved from its vertical position as shown in FIG. 1(*a*) into its horizontal position as shown in FIG. 1(*b*), the main body 2 of the lifting device 1 may be moved in the direction of an arrow 37 (FIGS. 1(*a*) and (*b*)). In this case, the center of gravity G of the winding roll 30 may be moving in the direction of an arrow 36 (FIGS. 1(*a*) and (*b*)), but the main body 2 itself may be moving in the direction of an arrow 37. As those motions cancel each other, the distance between the vertical line position of the center of gravity G of the winding roll 30 and the vertical line location of that part of the winding roll lifting device 1 that dynamically acts as the force point (which corresponds to the location of the pivotal pin 33 along the vertical line) may be kept to as small as possible (FIG. 1(*b*)). Thus, the movement of the winding roll 30 from its vertical position (FIG. 1(*a*)) into its horizontal position (FIG. 1(*b*)) can occur with stability.

The winding roll lifting device 1 of the present invention may also be used to move the winding roll 30 from its horizontal position (FIG. 1(*b*)) back to its vertical position (FIG. 1(*a*)). This may be performed by reversing the procedure described so far. Specifically, the controller (not shown) may be activated to provide a control signal that enables the gear motor 3 to rotate reversely, which is opposite the preceding case. As the gear motor 3 is rotating, its rotation will be transmitted to the screw rod member 17 through the bevel gears 15 and 16, causing the bearing 9 that engages the screw rod member 17 to move upwardly in the direction of an arrow 19 (FIG. 2). As the bearing 9 is moving up, the supporting shaft member 10, to which the bearing 17 is fixed, may also be moving in the direction of the arrow 19. This may cause the link member 14 to turn pivotally as indicated by the arrow 26, and the link member 8*c* to turn pivotally as indicated by the arrow 24. Then, the chuck member 8*a* may turn pivotally as indicated by the arrow 25, and the supporting arm member 5, whose pivotal movement is synchronized with that of the chuck member 8*c*, may also turn pivotally as indicated by the arrow 27 (FIG. 2). Finally, the winding roll 30 may be placed back in its vertical position as shown in FIG. 1(*a*).

According to the winding roll lifting device of the present invention, it may be appreciated that that part of the lifting device 1 that dynamically acts as the force point (which corresponds to the location of the pivotal pin 33) may be moved described. Therefore, the angle at which the winding roll 30 is to be inclined as it is being lifted by the lifting device may be adjusted to any desired angle. For example, in response to an appropriate control signal from the controller (not shown), the winding roll 30 may be placed at the angle shown in FIG. 2, and this angle may then be fine-adjusted. During this angle adjustment process, the distance between the position at which the center of gravity G of the winding roll 30 is located along the vertical line and that part of the lifting device 1 that dynamically acts as the force point (which corresponds to the location of the pivotal pin 33) may still be kept as small as possible. Thus, the operation can proceed safely and stably with the winding roll remaining inclined at any particular angle.

Second Embodiment

Figure 3:
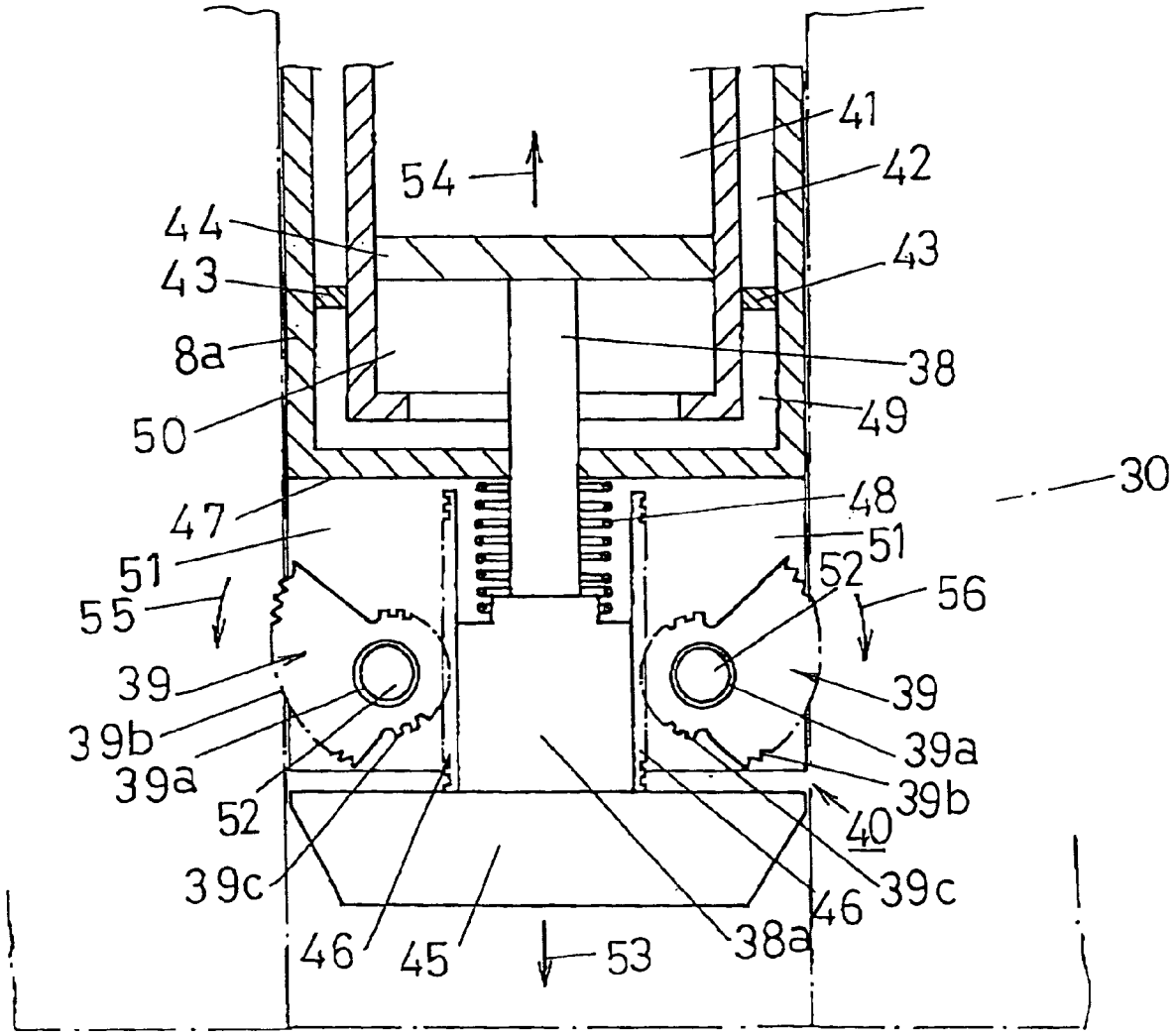
FIG. 3 is a partly cross sectional view illustrating the winding roll holding device in accordance with another preferred embodiment of the present invention, with some parts of the holding device being shown on an enlarged scale.
Figure 4:
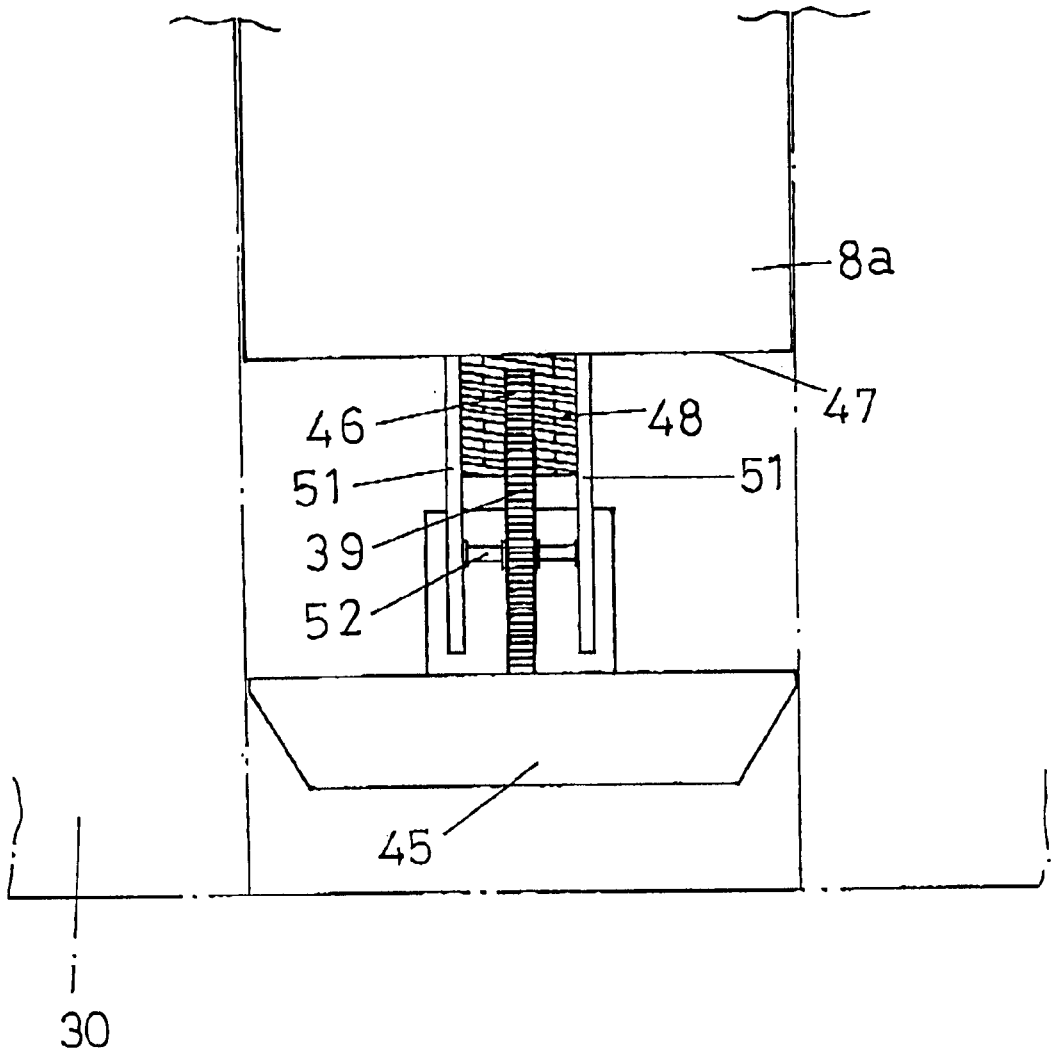
FIG. 4 is side view illustrating the holding device in FIG. 3.

Referring next to FIGS. 3 and 4, a particular preferred embodiment of the winding roll holding device according to the present invention is described below.

The winding roll holding device 40, which may be referred to simply as the holding device hereinafter, may be used in conjunction with the winding roll lifting device 1 described above in the first embodiment. When it is used with the lifting device, the holding device 40 may be mounted to the forward (distal) end of the chuck member 8*a*. In the following description, the description of the lifting device 1 is omitted in order to avoid duplication.

The holding device 40 includes a shaft member 38 that may be mounted to the forward end of the chuck member 8*a* that is adapted to be inserted into and engage the central recess of the winding roll 30 so that the shaft member 38 can advance or retract in the axial direction of the chuck member 8*a* (in the respective directions indicated by respective arrows 53, 54 in FIG. 3). An eccentric cam member 39 is supported on the forward (distal) end of the chuck member 8*a* so that the eccentric cam member 39 can pivot in the axial direction of the chuck member 8*a* (in the respective directions indicated by respective arrows 55, 56 or in the respective directions opposite the directions indicated by those arrows), and the pivotal movement of the eccentric cam member 39 may be synchronized with the advancing or retracting movement of the shaft 38.

In the embodiment shown in FIG. 3, the chuck member 8*a* has a dual-cylinder construction including an inner cylinder 41 and an outer cylinder 42. The outer cylinder 42 includes a first air cylinder section 49 that is closed by a ring 43 mounted in the space delimited by the inner and outer cylinders. The ring 43 is provided to prevent air leaks from the first air cylinder section 49.

The chuck member 8*a* further includes a shaft member 38 that extends through the center of its bottom plate 47(FIG. 4). The shaft member 38 has a disk plate 44 at a first end that is mounted at a right angle with regard to the shaft member 38. The shaft member 38 has a diametrically enlarged section 38*a* at the second end, to which a tapered cap 45 is secured. The tapered cap 45 is tapered toward its tip, as shown in FIG. 3. The diametrically enlarged section 38*a* has a rack 46, 46 on each of the opposite sides thereof, extending in the axial direction of the shaft member 38 (that is, in the axial direction of the chuck member 8*a*).

As shown in FIG. 3, the inner cylinder 41 includes a second air section 50 that is delimited by the disk plate 44.

It should be noted that the cap 45 having the tapered tip is provided to permit the easy insertion of the chuck member 8*a* into the central recess of the winding roll 30.

The chuck member 8*a* further includes a spring 48 that is mounted around the portion of the shaft member 38 between the bottom plate 47 and the diametrically enlarged section 38*a*. The spring 48 is normally biased to urge the shaft member 38 toward the direction of an arrow 53.

In the following description, one of two eccentric cam members 39, 39 that are mounted on both sides is described, and the description may similarly apply to the other eccentric cam member 39. Two support plates 51, 51 opposite each other extend from the bottom plate 47 as shown in FIG. 4. The two support plates 51, 51 are provided to support both ends of a shaft member 52. The eccentric cam members 39 are secured to the shaft member 52 so that they can turn pivotally in the axial direction of the chuck member 8*a* (in the direction indicated by the corresponding one of arrows 55 or 56 or in the direction opposite to that arrow in FIG. 3). The eccentric cam member 39 has a pinion section 39*c* that meshes with a corresponding one of the two racks 46 that are provided on the opposite sides of the diametrically enlarged section 38*a*, as shown in FIG. 3.

The eccentric cam member 39 has an off-center hole 39*a* through which the shaft member 52 is inserted, and is formed such that the distance from the hole 39*a* to the peripheral edge is gradually varying from the longer axis side toward the shorter axis side. The eccentric cam member 39 has a biting (friction) section 39*b* formed like saw teeth around the peripheral edge thereof, and the pinion section 39*c* described above may mesh with the rack 46.

As it may be understood from the foregoing description and seen from FIG. 3, the eccentric cam member 39 is provided on each of the opposite sides of the shaft 38, and it is mounted in such a manner that its longer axis side is located nearer to the bottom plate 47 of the chuck member 8*a*.

As described, the eccentric cam member 39 is operatively linked with the shaft member 38, and the pivotal movement of the eccentric cam member 39 may be caused by making its pinion section 39*c* engage the rack 46 as the shaft member 38 is advancing or retracting.

Now, the operation of the winding roll holding device 40 that has been described abovewill be described with the followingstep-by-step procedure.

When no air is fed into the first air cylinder section 49, the diametrically enlarged section 38*a* of the shaft member 38 may be urged by the action of the spring 48 toward the direction indicated by arrow 53. This may cause each of the eccentric cam members 39, 39 to turn pivotally in the respective direction opposite the arrow 55, 56, so that the biting section 39*b* located on the shorter axis side may be made to face the corresponding peripheral surface side of the chuck member 8*a*, although this is not shown. It is noted that the radius of the eccentric cam member 39 located on the shorter axis side is designed to have a length that prevents the biting section 39*b* on the shorter axis side from projecting out beyond the peripheral surface of the chuck member 8*a*. That is, the biting section 39*b* on the shorter axis side can completely be accommodated between the two support plates 51, 51 opposite each other.

When lifting and moving the winding roll 30 in its initial vertical position into its horizontal position by means of the winding roll lifting device 1 (FIG. 1), the first step is to cause the chuck member 8*a* to engage the winding roll 30 by causing the chuck member 8*a* to be inserted into the central recess on the winding roll.

When the chuck member 8*a* is inserted into the central recess of the winding roll 30, compressed air is then fed into the outer cylinder 42, causing the ring 43 to move down in the direction of the arrow 53 in FIG. 3. As it is moving down, the ring 43 may be operated to compress the air within the first air cylinder section 49. As the air is thus compressed, it may be forced to flow through the first air cylinder section 49 into the second air cylinder section 50, causing the disk plate 44 to move up in the direction of the arrow 54.

It should be noted that the feeding of the compressed air into the outer cylinder 42 may be accomplished by using a pressure applying means (not shown) that is employed in the prior art to deliver the compressed air into an inflatable member (not shown), which is provided around the outer surface of the chuck member 8*a*. In this case, the inflatable member that is filled with the air would press the chuck member 8*a* more against the inner surface of the central recess on the winding roll 30, so that the chuck member 8*a* can have its outer surface engage the inner surface of the central recess more firmly.

As the disk plate 44 moves up under the pressure of the compressed air in the direction of the arrow 54, the shaft member 38 also moves up in the direction of the arrow 54 (that is, it is retracted into the chuck member 8*a*) against the action of the spring 48.

As the shaft 38 is retracting into the chuck member 8*a*, the rack 46, 46 also moves in the same direction. Thus, the eccentric cam member 39, 39 whose pinion section 39*c* is in mesh with the rack 46, turns as indicated by the respective arrow 55, 56.

As the eccentric cam member 39 is turning as indicated by the respective arrow 55, 56, the biting (friction) section 39*b*, which has been completely accommodated between the two support plates 51, has its longer radius side project out of the chuck member 8*a*. In this way, the biting section 39*b* may be brought into contact with the inner wall of the central recess on the winding roll 30, and may be pressed against the inner wall. Thus, the inner wall of the central recess on the winding roll 30 may be engaged by the biting section 39*b* of the eccentric cam member 39.

If the winding roll 30 being lifted by the lifting device (FIG. 1) in the above state should be moving in the direction of the arrow 53, i.e., in the vertical direction, because of its own weight, the eccentric cam member 39, having the biting section 39*b* engaging the inner wall of the central recess on the winding roll 30, may be turned as indicated by the respective arrow 55, 56, because the eccentric cam member 39 is supported to turn pivotally in the axial direction of the chuck member 8*a*.

As the eccentric cam member 39 turns more in the direction of the respective arrow 55, 56, it may be pressed against the inner wall of the central recess more firmly. This may prevent the winding roll 30 from slipping out of the chuck member 8*a*. Thus, the winding roll 30 can be handled with high stability and with high safety.

Because the biting section 39*b* of the eccentric cam member 39 is arranged such that its longer radius side may be projected automatically when the weight of the winding roll 30 acts upon the eccentric cam member 39, the longer radius side of the biting section 39*b* may thus be brought into contact with the inner peripheral wall of the central recess on the winding roll 30 just before the winding roll 30 is lifted. The winding roll holding device 40 may be activated at the very moment when the biting section 39*b* begins to make contact with the inner wall of the central recess on the winding roll 30.

The following description concerns the operation of the holding device 40 that may occur when the chuck member 8*a* is to be removed from the winding roll 30.

First, the compressed air that exists within the outer air cylinder section 42 is released. This releases the compressed air from the first air cylinder section 49, and then from the second air cylinder section 50. Upon releasing the compressed air from both air cylinder sections, the force that has pushed the disk plate 44 in the directions as indicated by the arrow 54 in FIG. 3 will then stop. The spring 48 that has been compressed between the bottom 47 and the diametrically enlarged section 38*a* will then return to its original (normal) position, causing the shaft member 38 to move in the direction of the arrow 53.

As the shaft member 38 is moving in the direction 53, the rack 46 will also be moving, causing the eccentric cam member 39 whose pinion section 39*c* is in mesh with the rack 46 to be turned pivotally in the respective direction opposite that as indicated by the respective arrow 55, 56.

As the eccentric cam member 39 is turning in the respective direction opposite that as indicated by the respective arrow 55, 56, the shorter radius side of the biting section 39*b* may be brought back to face the peripheral surface side of the chuck member 8*a* so that the biting section 39*a* can be completely accommodated again in the space or gap between the two support plates 51. Thus, the inner wall of the central recess on the winding roll 30 is disengaged from the biting section 39*a*. Now, the chuck member 8*a* may be removed from the central recess on the winding roll 30.

The winding roll holding device 40 that has been described so far in connection with the particular embodiment of the present invention may be used in conjunction with the winding roll lifting device described above in the first embodiment, or may be used in conjunction with the prior art winding roll lifting device. In either case, the holding device 40 may be mounted to the forward (distal) end of the chuck member 8*a* of the winding roll lifting device 1 according to the present invention, or to the forward (distal) end of the chuck member of the winding roll lifting device according to the prior art.

In the embodiment of the winding roll lifting device 40 described above, the chuck member 8*a* includes the combination of the air pump and air cylinder for causing the shaft member 38 to advance or retract. It should be noted, however, that the air pump and air cylinder combination may be replaced by the arrangement that allows the shaft member 38 to advance or retract by any direct mechanical means. The important requirement is that the retracting movement of the shaft member 38 can be achieved by permitting the biting section 39*b* of the eccentric cam member 39 to engage the inner wall of the central recess on the winding roll 30 even slightly, just before the winding roll 30 is being lifted by the winding roll lifting device. Any means that would meet the above requirement could be used.

What is claimed is:

1. A winding roll lifting device, comprising:

a main body including a driving mechanism for moving a winding roll between a vertical position and a horizontal position, said main body having a first end and a second end opposite said first end;

a supporting arm having a first end and a second end opposite said first end, said first end of said supporting arm being pivotally connected to said first end of said main body so that said supporting arm is operable to pivot about said first end of said main body;

a hook member having a base end pivotally connected to said second end of said supporting arm so that said hook member extends from said supporting arm and is operable to pivot about said second end of said supporting arm; and a chuck member having a distal end to be inserted into a central recess of the winding roll so as to engage the central recess, and having a base end opposite said distal end, said base end being pivotally connected to said second end of said main body so that said chuck member is operable to pivot about said second end of said main body;

wherein said main body, said supporting arm, and said chuck member are arranged such that said driving mechanism is operable to drive said chuck member so that said chuck member pivots about said second end of said main body to thereby move between a vertical position and a horizontal position, and such that said supporting arm pivots about said first end of said main body in synchronization with the pivotal movement of said chuck member so as to move in a direction approaching and extending away from said chuck member, whereby said chuck member is operable to move the winding roll between the vertical position and the horizontal position when said distal end of said chuck member is inserted into and engages the central recess of the winding roll.

2. The winding roll lifting device of claim 1, wherein said chuck member includes a winding roll holding device, said winding roll holding device including:

a shaft member connected to said distal end of said chuck member, said shaft member being operable to advance and retract along an axial direction of said chuck member; and an eccentric cam pivotally supported on said distal end of said chuck member so that said eccentric cam is operable to pivot with respect to the axial direction of said chuck member, said eccentric cam being operatively linked with said shaft member so that the pivotal movement of said eccentric cam is synchronized with the advancing and retracting movement of said shaft member.

3. The winding roll lifting device of claim 1, wherein said main body includes a screw rod operable to rotate about a longitudinal axis of said screw rod, and includes a support shaft member linked to said screw rod so as to move along said longitudinal axis of said screw rod as said screw rod rotates, said lifting device further comprising an arm rod having a first end pivotally connected to said supporting arm, and having a second end pivotally connected to said base end of said chuck member, a center section of said arm rod located between said first end of said arm rod and said second end of said arm rod being fitted to said support shaft member, said driving mechanism being operable to rotate said screw rod.

4. A winding roll lifting device, comprising:

a main body including a driving mechanism, said main body having a first end and a second end opposite said first end;

a supporting arm having a first end and a second end opposite said first end, said first end of said supporting arm being pivotally connected to said first end of said main body so that said supporting arm is operable to pivot about said first end of said main body;

a hook member having a base end pivotally connected to said second end of said supporting arm so that said hook member extends from said supporting arm and is operable to pivot about said second end of said supporting arm;

a lifting arm including a chuck member having a base end pivotally connected to said second end of said main body so that said lifting arm is operable to pivot about said second end of said main body, and having a distal end to be inserted into a central recess of the winding roll so as to engage the central recess;

a support shaft member driven by said driving mechanism so as to move upwardly and downwardly within said main body; and an arm rod fitted to said supporting shaft member at a center section of said arm rod, said arm rod having first end pivotally connected to said supporting arm, and having a second end pivotally connected to said lifting arm.

5. The winding roll lifting device of claim 4, wherein said chuck member includes a winding roll holding device, said winding roll holding device including:

a shaft member connected to said distal end of said chuck member, said shaft member being operable to advance and retract along an axial direction of said chuck member; and an eccentric cam pivotally supported on said distal end of said chuck member so that said eccentric cam is operable to pivot with respect to the axial direction of said chuck member, said eccentric cam being operatively linked with said shaft member so that the pivotal movement of said eccentric cam is synchronized with the advancing and retracting movement of said shaft member.

6. The winding roll lifting device of claim 4, wherein said main body includes a screw rod operable to rotate about a longitudinal axis of said screw rod, said support shaft member being linked to said screw rod so as to move along said longitudinal axis of said screw rod as said screw rod rotates, said driving mechanism being operable to rotate said screw rod.

* * * * *